US006336761B1

(12) United States Patent
Kudo

(10) Patent No.: US 6,336,761 B1
(45) Date of Patent: Jan. 8, 2002

(54) KNOCK-TYPE WRITING INSTRUMENT

(75) Inventor: Naoto Kudo, Tokyo (JP)

(73) Assignee: Zebra Co., Ltd., Tokyo (JP)

( * ) Notice: Subject to any disclaimer, the term of this patent is extended or adjusted under 35 U.S.C. 154(b) by 0 days.

(21) Appl. No.: 09/497,796

(22) Filed: Feb. 4, 2000

(30) Foreign Application Priority Data

Oct. 14, 1999 (JP) ..... 11-292405

(51) Int. Cl.[7] ..... B43K 7/12; B43K 24/06; B43K 24/08

(52) U.S. Cl. ..... 401/106; 401/111; 401/117; 401/179; 401/180; 401/182

(58) Field of Search ..... 401/104–106, 401/110, 111, 117, 179, 180, 182

(56) References Cited

U.S. PATENT DOCUMENTS

| | | | | |
|---|---|---|---|---|
| 3,144,005 A | | 8/1964 | Johmann | |
| 3,146,758 A | * | 9/1964 | Zepell | 401/106 |
| 3,164,132 A | | 1/1965 | Ganz | |
| 3,192,904 A | | 7/1965 | Johmann | |
| 3,326,189 A | | 6/1967 | Baer | |
| 3,797,945 A | | 3/1974 | Zepell | |
| 3,819,282 A | | 6/1974 | Schultz | |
| 5,601,376 A | | 2/1997 | Badr et al. | |
| 5,871,296 A | * | 2/1999 | Furukawa et al. | 401/106 |
| 5,915,866 A | * | 6/1999 | Furukawa | 401/106 |
| 5,918,993 A | | 7/1999 | Koyama | |

FOREIGN PATENT DOCUMENTS

| | | |
|---|---|---|
| JP | 08164696 | 6/1996 |
| JP | 10264584 | 10/1998 |

OTHER PUBLICATIONS

English language abstract of JP 10–264584.
English language abstract of JP 8–164696.

* cited by examiner

*Primary Examiner*—Gregory Huson
*Assistant Examiner*—Kathleen J. Prunner
(74) *Attorney, Agent, or Firm*—Greenblum & Bernstein, P.L.C.

(57) ABSTRACT

The subject of the invention is to provide a knock-type writing instrument in which a cloth can be prevented from being stained by the clip releasing mechanism having a compact structure when the writing instrument is stored in a pocket and further the writing extremity end can be prevented from being damaged under the projected state by an unintended use of it. The window hole is formed at the peripheral surface of the barrel, the ball section of the clip is provided with the inner protrusions which can be extended or retracted into said window hole, the rotor is provided with a plurality of peripheral protrusions at the outer peripheral surface in a circumferential direction so as to stop the rotor by being abutted against said inner protrusions of the clip when said extremity end is projected, the inner protrusions of the clip are moved toward an outer side of the shaft as the clip is opened when said extremity end is projected, resulting in that the protrusions are not abutted against the peripheral protrusions of the rotor and then the rotor is rotated to cause the writing extremity end to be retracted into the barrel.

4 Claims, 6 Drawing Sheets

KNOCK-TYPE WRITING INSTRUMENT

BACKGROUND OF THE INVENTION

1. Field of the Invention

This invention relates to a knock-type writing instrument in which the writing extremity end is extended out of or retracted into the instrument through a knocking operation, and more particularly a knock-type writing instrument provided with a clip releasing mechanism for releasing said extended-out state when the clip is opened under a state in which the writing extremity end is extended out of the instrument.

2. Description of the Related Art

As this kind of knock-type writing instrument in the prior art, there has been provided, as already disclosed in the gazette of Japanese Patent Laid-Open No. Hei 10-264584, a writing instrument in which the outer peripheral surface of the rotor is axially provided with protrusions to be guided at the fixed cam slant surface of the inner surface of the barrel, and protruded engaging section formed at the front side of said protrusions and engaged with the concave engaged sections inside the ball at the extremity end of the clip.

This knock-type writing instrument is constituted such that an engaged state having said protruded engaging section at the outer peripheral surface of the rotor engaged with said concave engaging section of the clip is released to cause the extremity end of the writing instrument to be retracted by an opening operation of a clip when the writing instrument is put into the pocket in order to prevent the extremity end of the writing instrument from staining a cloth when the writing instrument is stored in a pocket of the cloth under a state in which the inner end of the writing instrument is being protruded by accident.

However, the aforesaid prior art knock-type writing instrument had a disadvantage that the axial length of the rotor is elongated due to the fact that the protrusion for use in guiding the fixed cam slant surface of the inner surface of the barrel and the protruded engaging section to be engaged with the concave engaged section inside the ball at the extremity end of the clip are separately arranged axially at the outer peripheral surface of the rotor. That is, since the axial space in the barrel was restricted by the rotor, this fact caused improvements of the writing instrument such as an increased ink volume in the writing instrument by extending the length of the refill or an arrangement of compact-sized writing instrument by shortening the length of the barrel and the like, for example, to be difficult.

In addition, in the case of the aforesaid prior art knock-type writing instrument, although the extremity end of the writing instrument was retracted into the barrel through the depressing operation at the knock part other than its practical use to protect by itself, there was a possibility that the writing extremity end was apt to be damaged when the writing instrument was dropped while the writing extremity end was being faced downward with the writing extremity end being exposed or when the writing was carried out with an excessive high writing pressure or when a load more than that required for writing operation directed toward the rear part of the barrel was applied to the writing extremity end. For example, in the case that the writing instrument was a ball-point pen, it was afraid that the extremity end edge of the tip was deformed, the ball was not rotated to cause the writing operation to become impossible or ink was flowed out between the ball and the extremity end.

SUMMARY OF THE INVENTION

The present invention has been invented in reference to the aforesaid circumstances and it is an object of the present invention to provide a knock-type writing instrument in which the cloth can be prevented from being stained with ink when the writing instrument is stored in a pocket and further the writing extremity end can be prevented from being damaged while it is being extended out of the barrel under an unintended state of use by a clip releasing mechanism having a compact structure.

The technical means of the present invention to resolve the aforesaid problems consists in a knock-type writing instrument having a clip releasing mechanism operated such that a knock rod arranged at the rear end of a barrel is knocked to enable a writing extremity end of a refill to be extended out of or retracted into an extremity end port of the barrel by a thrust lock mechanism provided with a rotor and a return spring, the rotor is engaged with a ball of a clip at the time of extended-out state and the engaged state of the rotor is released under an opening operation of said clip and this is characterized in that:

a window hole is opened at a peripheral surface of the barrel, the ball at the extremity end of the clip is provided with an inner protrusion which can be extended out of or retracted into said window hole;

the rotor is provided with a plurality of peripheral protrusions at its outer peripheral surface in a circumferential direction thereof to stop its rotation by being abutted against said inner protrusion of the clip when the writing extremity end is extended out of the barrel;

said thrust lock mechanism is provided with a fixed cam slant surface formed at the inner peripheral surface of the barrel, a thrust cam slant surface formed at the extremity end of the knock rod and axially slid in integral with said knock rod, a rotary cam slant surface formed at the rear end of the rotor, and a guiding slant surface formed at the surface of the writing extremity end at said inner protrusion;

said thrust lock mechanism causes the rotor to be rotated while said peripheral protrusion is guided by the fixed cam slant surface after said rotary cam slant surface is guided by the thrust cam slant surface when the knock operation for extending out the writing extremity end is carried out, one of said plurality of peripheral protrusions is abutted against said inner protrusion to cause the rotor to be stopped, and in turn when a knock operation for retracting the writing extremity end is carried out, one of said peripheral protrusions being abutted against the inner protrusion is guided by said guiding slant surface of the inner protrusion to cause the rotor to be rotated and said writing extremity end to be retracted after said rotary cam slant surface is guided by the thrust cam slant surface.

In accordance with the aforesaid technical means, the present invention has two functions, i.e. one function in which the peripheral protrusions of the rotor are guided by the fixed cam slant surface and the other function in which they are engaged with the ball at the extremity end of the clip. Then, when the writing extremity end is extended out of the barrel, a rotation of the rotor is stopped by abutting the peripheral protrusions at the outer peripheral surface against the inner protrusions of the clip. Accordingly, as the clip is opened, the inner protrusion of the clip is moved out of the barrel and is not abutted against the peripheral protrusions of the rotor, resulting in that the rotor is rotated to cause the writing extremity end to be retracted into the barrel.

In addition, in order to prevent the writing extremity end kept at its extended-out state from being damaged, there is provided a knock-type writing instrument having a clip releasing mechanism operated such that a knock rod arranged at the rear end of a barrel is knocked to enable a writing extremity end of a refill to be extended out of or retracted into an extremity end port of the barrel by a thrust lock mechanism provided with a rotor and a return spring, the rotor is engaged with a ball of a clip at the time of extended-out state and the engaged state of the rotor is released under an opening operation of said clip, wherein a window hole is opened at a peripheral surface of the barrel, the ball at the extremity end of the clip is provided with an inner protrusion which can be extended out of or retracted into said window hole;

the rotor is provided with a plurality of peripheral protrusions at its outer peripheral surface to stop its rotation by being abutted against said inner protrusion of the clip when the writing extremity end is extended out of the barrel; and the clip is constituted such that said inner protrusion is pushed up by said abutted peripheral protrusion when the writing extremity end at its protruded position is pushed in an axial rearward direction with a force of more than a predetermined load.

In this case, the aforesaid thrust lock mechanism is a mechanism constituted such that the extremity end of the knock rod and the rear end of the rotor, or the outer peripheral surface of the rotor and the inner peripheral surface of the barrel and the like are formed with cam slant surfaces to be engaged to each other, the rotor biased at the leading end side by a return spring is rotated under an engaging action of said cam slant surfaces, and the rotor is formed at a position where the writing extremity end of the refill installed at the extremity end of the rotor is extended out of the barrel extremity end port and another position where the writing extremity end is retracted from the barrel extremity end port.

In accordance with the aforesaid technical means, rotation of the rotor is prevented from being carried out by a method wherein the peripheral protrusions at the outer peripheral surface are abutted against the inner protrusions of the clip when the writing extremity end is extended out of the barrel. Accordingly, when the clip is opened, the inner protrusions of the clip are moved in an outward direction of the barrel and are not abutted against the peripheral protrusions of the rotor, resulting in that the rotor is rotated to cause the writing extremity end to be retracted into the barrel.

In addition, as the writing extremity end at the extended-out position is pushed rearwardly of the barrel with a force more than a predetermined load when the writing extremity end is extended out of the barrel, its pushing action becomes a rotating force for the rotor and the rotor is tried to rotate to push up the inner protrusions at the extremity end of the clip with the peripheral protrusions. Then, the clip is resiliently opened to cause the engaged state of the rotor to be released and the writing extremity end is retracted into the barrel.

Further, in order to attain a configuration of the clip in which said inner protrusions are pushed up with said peripheral protrusions being abutted when the writing extremity end at its extended-out position is pushed rearwardly of the barrel with a force more than a predetermined load, it is preferable that the abutted section between the aforesaid inner protrusion and the aforesaid peripheral protrusion is formed with a slant surface slidably contacted with the aforesaid peripheral protrusion and pushed up by it. In addition, it is satisfactory that said slant surface is of an R-shaped surface slidably contacted with the afore said peripheral protrusion and pushed up by it. Further, it does not show any problem to provide a configuration in which the inner protrusions are pushed up over the peripheral protrusions by making a proper setting of a tension force of the clip.

Further, preferably, the angle of said slant surfaces is set to be about 30°.

DESCRIPTION OF THE PREFERRED EMBODIMENT(S)

Figure 1A:
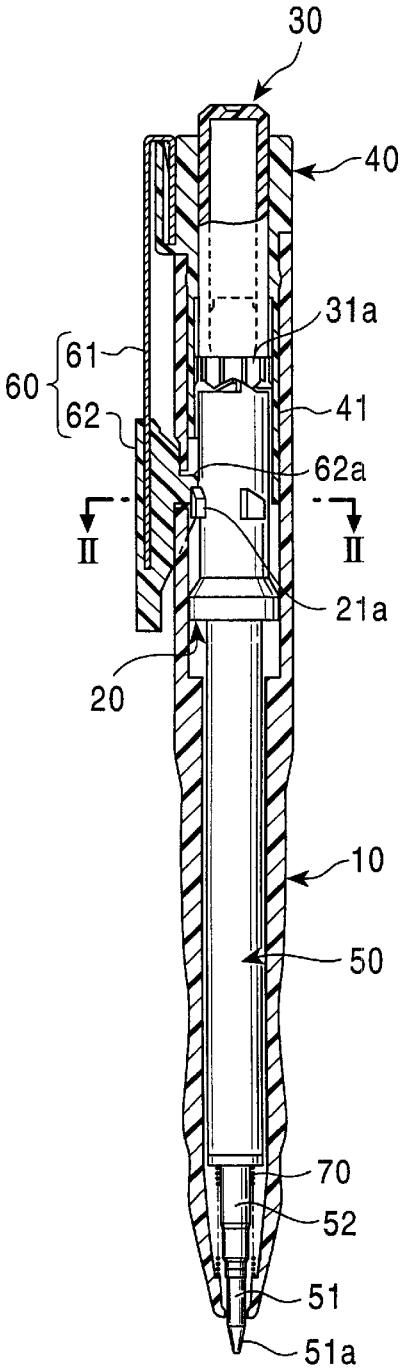
FIGS. 1A to 1C are longitudinal section for showing one example of a knock-type writing instrument of the present invention, wherein 1A shows a state in which the writing extremity end is projected, 1B shows a state in which the peripheral protrusions of the rotor push up the inner protrusions of the clip, and 1C shows a state in which the engaged state of the rotor is released to cause the writing extremity end to be retracted into the barrel.

Referring now to the drawings, one preferred embodiment of the present invention will be described as follows.

FIGS. 1A to 6D illustrate one example of a knock-type writing instrument of the present invention.

This knock-type writing instrument is a knock-type ball-point pen comprised of a barrel 10 having an extremity end port integrally formed with it, a refill 50 stored in the barrel 10 and biased by a return spring 70, a rotor 20 installed at the rear end of the refill 50, a knock rod 30 arranged at the rear side of the rotor 20, a rear end shaft 40 fitted and fixed to the rear end of the inner peripheral surface of the barrel 10, and a clip 60 fitted to the rear end shaft 40, wherein there is provided a thrust lock mechanism in which the knock rod 30 is depressed with a force to cause the rotor 20 to be slid or rotated and then the writing extremity end 51*a* of the tip 51 is extended out of or retracted into the barrel extremity end port 12, wherein a clip releasing mechanism for retracting the projected-out writing extremity end 51*a* under the opening operation of the clip 60.

The barrel 10 is of a substantial cylindrical shape having a fine leading end port integrally formed with it, wherein its most-forward end has an extremity end port 12 of the barrel for use in extending out or retracting the writing extremity end 51*a,* the peripheral surface of the rear end of it has a substantial rectangular window hole 11, and two slit holes 13, 13 arranged to hold the window hole 11 therebetween.

The refill 50 is constructed such that the tip 51 is connected to the extremity end of an ink storing pipe 53 through a coupler 52 of which diameter is reduced substantially by about a full size of the diameter of the ink storing pipe 53, the return spring 70 having its extremity end engaged in the barrel is inserted around the coupler 52 and then the refill is stored in the barrel 10 under a state in which it is biased rearwardly of the barrel by the return spring 70.

The rotor 20 is comprised of a cylinder 21 having an installing hole 21*c* into which the rear end of the refill 50 is installed, and a free fitting part 22 in which its diameter is reduced so as to be rotatably fitted into the knock rod 30 to be described later and it is integrally formed with the rear end of said cylinder 21, wherein the outer peripheral surface of the cylinder 21 is formed with three peripheral protrusions 21*a* arranged in a circumferential direction at the outer peripheral surface of the cylinder 21 and projected in a direction of its diameter, the rear end of the cylinder 21 is formed with three rotary cam slant surfaces 21*b* projected rearwardly of the shaft and rotatably stored in the rear end of the barrel 10.

The peripheral protrusion 21*a* is formed with a slant surface 21*a*-1 slidably contacted with a fixed cam slant surface 41*a*-1 of the rear end barrel 40 to be described later and a guiding slant surface 62*a*-2 of a ball part 62 at the extremity end of the clip 60 at the side surface of the rear part of the shaft.

In addition, the rotary cam slant surface 21*b* is a slant surface formed such that a location at the rear end of the cylinder 21 corresponding to each of the aforesaid peripheral protrusions 21*a* is projected like a triangle as seen in its front elevational view and its side part is slidably contacted with a thrust cam slant surface 31*a*-1 to be described later.

An inside part of the knock rod 30 is formed with a free fitting hole 30*a* into which a free fitting part 22 of the rotor 20 is rotatably fitted, its rear end is of a substantial closed cylindrical shape, its extremity end is formed with a thrust cam part 31 and its rear end is projected from the rear end barrel 40 so as to be operated with a knock.

The thrust cam part 31 has a plurality of protrusions 31*a* of substantial isosceles triangle projected toward the extremity end of the shaft, one side of each of the protrusions 31*a* forms a thrust cam slant surface 31*a*-1 for guiding the aforesaid rotary cam slant surface 21*b* and rotating the rotor 20.

In addition, the peripheral surface of each of the aforesaid protrusions 31*a* is formed with a thrust protrusion 31*a*-2 engaged with an axial longitudinal groove 10*a* formed at the inner surface of the fixed cam 41 of the rear end barrel 40 and enabling the knock rod 30 to be axially slid.

The rear end barrel 40 is formed into a substantial cylindrical shape comprised of a fixed cam section 41 at the extremity end thereof and a cylindrical flange 42 at the rear end formed to have a substantial same outer diameter as an outer diameter of the barrel 10, wherein the fixed cam section 41 is fitted to the rear end in the barrel 10 and at the same time the cylindrical flange 42 is fixed under a state in which it is projected from the rear end of the barrel 10.

As shown in the developed figures of FIGS. 5A–5C and 6A–6D, the fixed cam section 41 is formed such that its extremity end is formed into a corrugated shape, wherein the extremity end of each of the two protrusions 41*a* is formed with the fixed cam slant surface 41*a*-1 for guiding the aforesaid peripheral protrusions 21*a* and for rotating the rotor 20 (refer to FIGS. 5A–5C and 6A–6D).

In addition, the cylindrical flange section 42 is formed, at its side surface, with a clip fitting section 42*a* into which an engaging piece 61*a* at the rear end of the clip 60 is inserted from the rear side and fitted, wherein this clip fitting part 42*a* is fitted into a recess 10*b* formed at the rear end of the barrel 10 and the rear end cylinder 40 is fixed in such a way that it may not be rotated in a peripheral direction (refer to FIG. 4).

The clip 60 is made such that a ball section 62 made of resin material is formed at the extremity end of the clip main body 61 comprised of a metallic plate.

The clip main body 61 is formed such that its rear end is bent into a U-shape and the bent extremity end is formed with an engaging piece 61*a* fitted to the clip fitting part 42*a* of the rear end barrel 40. The engaging piece 61*a* is formed to have both side surfaces of saw-teeth shape in such a way that it may not be easily pulled out of the clip fitting part 42*a*.

Figure 2:
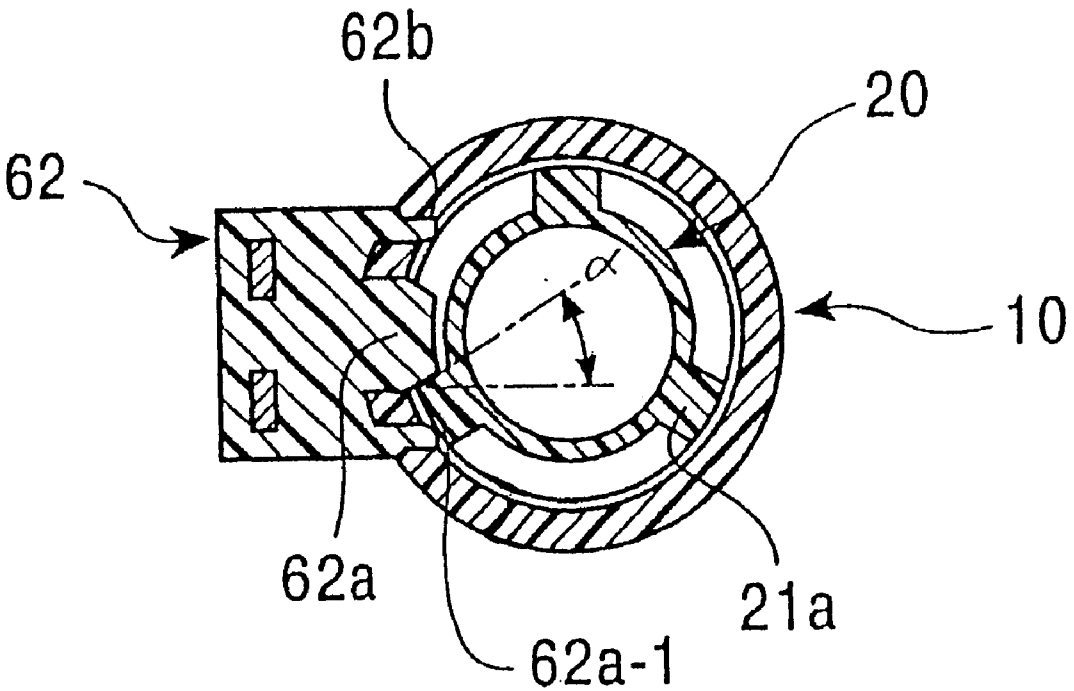
FIG. 2 is a sectional view taken along line (2)—(2) in FIG. 1A.
Figure 3:
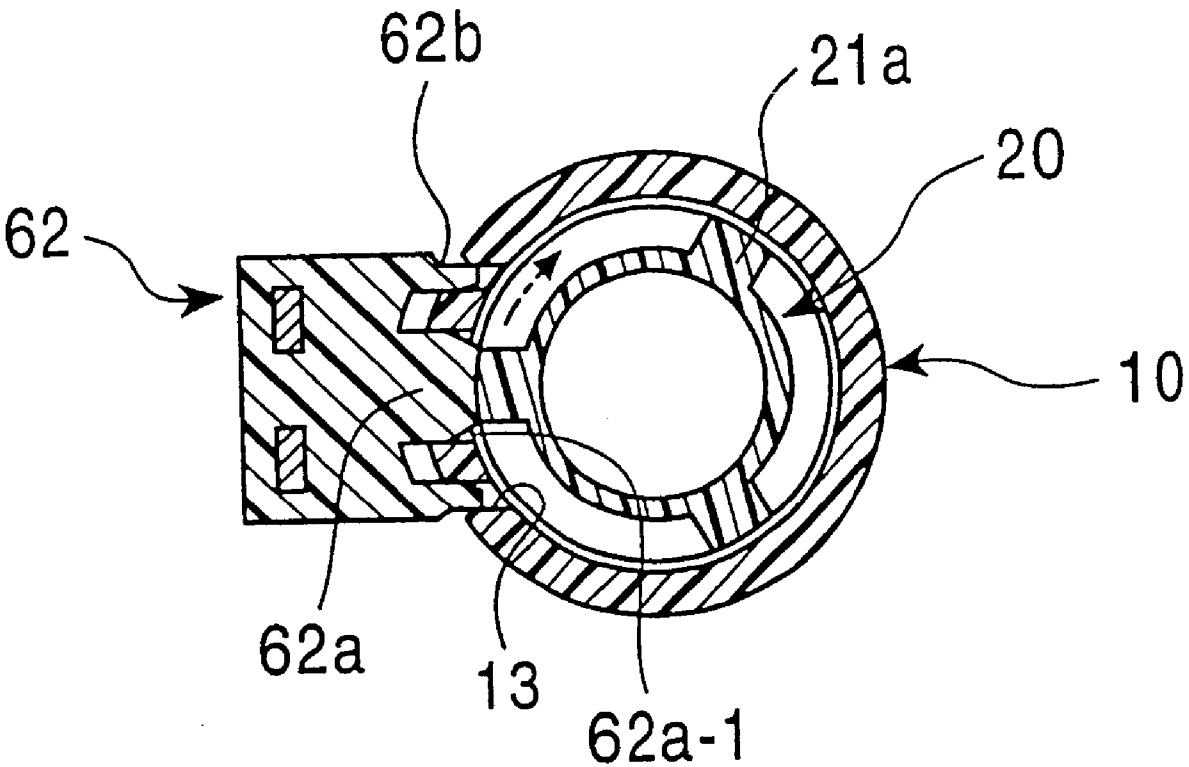
FIG. 3 is a sectional view taken along line (3)—(3) in FIG. 1B.
Figure 4A:
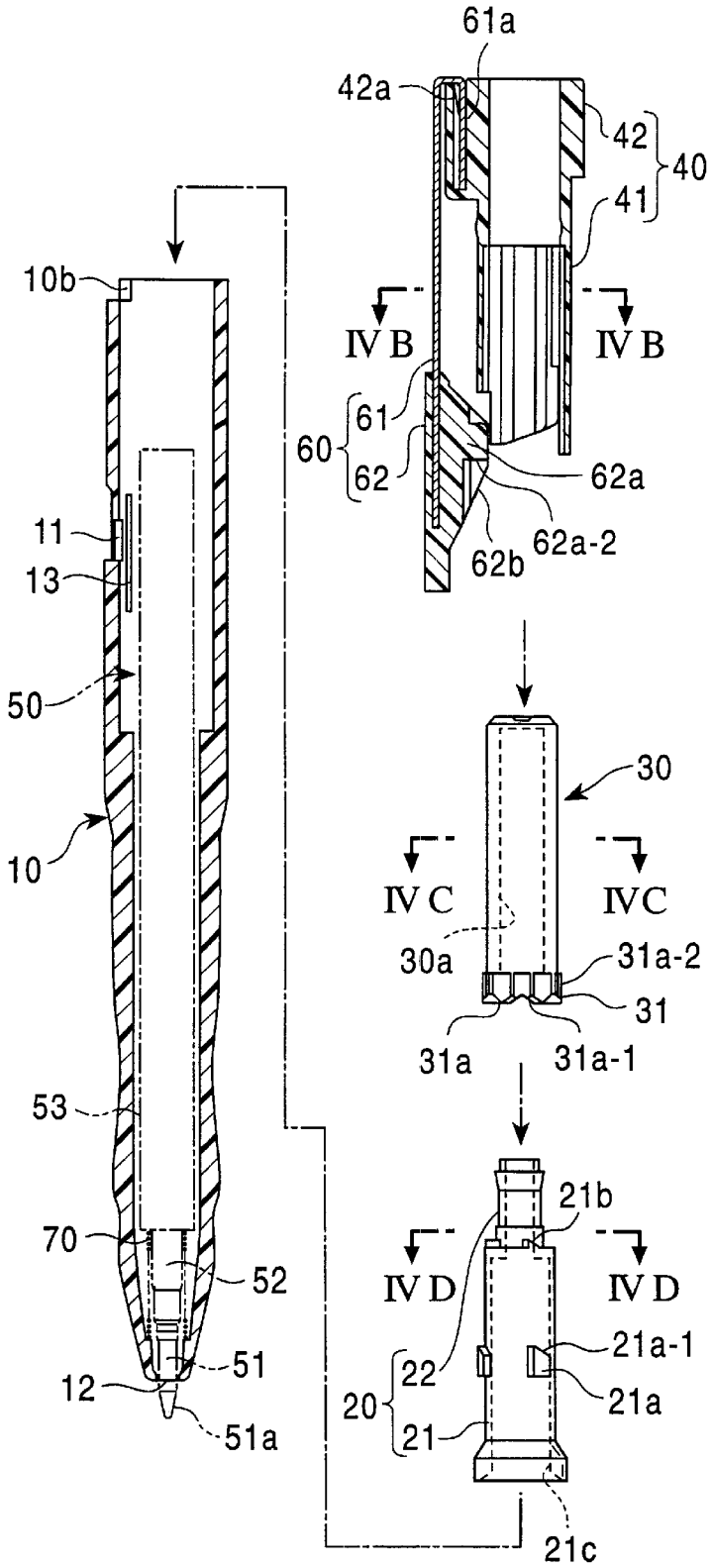
FIGS. 4A to 4D are exploded view for showing the knock-type writing instrument, wherein 4B is a sectional view taken along line IVB—IVB of FIGS. 4A, 4C is a sectional view taken along line IVC—IVC of FIGS. 4A and 4D is a sectional view taken along line IVD—IVD of FIG. 4.
Figure 4B:
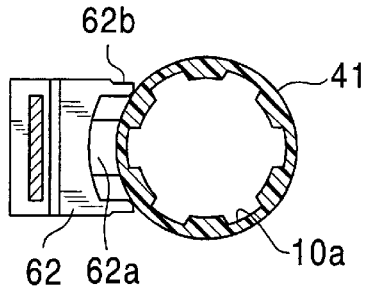
Figure 4C:
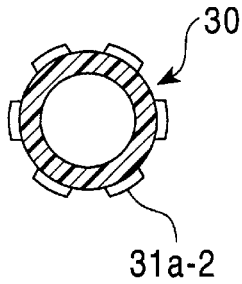
Figure 4D:
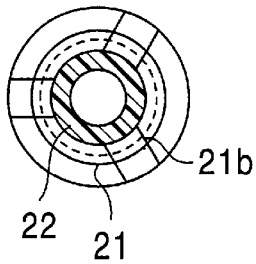

In addition, the ball section 62 is formed with an inner protrusion 62*a* arranged at a substantial central part of the plane of the ball section 62 at the barrel 10 and two longitudinal protrusions 62*b,* 62*b* arranged to hold the inner protrusion 62*a,* wherein when the clip 60 is opened or closed, the inner protrusion 62*a* is extended out of or retracted into the window hole 11 at the peripheral surface of the barrel 10 and at the same time the longitudinal protrusions 62*b,* 62*b* are extended out of or retracted into the slit holes 13, 13 at the peripheral surface of the barrel 10 (refer to FIGS. 2 and 3).

The aforesaid inner protrusion 62*a* is formed such that it may be projected out through the window hole 11 into the barrel 10, wherein when the knock rod 30 is depressed to cause the writing extremity end 51*a* to be projected out of it, the side surface of the peripheral protrusion 21*a* of the rotating rotor 20 is abutted against said inner protrusion 62*a* to cause the rotation of the rotor 20 to be stopped.

In addition, the surface of the inner protrusion 62*a* at the writing extremity end 51*a* is formed with a guiding slant surface 62*a*-2. This guiding slant surface 62*a*-2 causes the peripheral protrusion 21*a* moved toward the extremity end of the shaft together with the knock rod 30 when the knock rod 30 is depressed again to cause the writing extremity end 51*a* to be retracted under the engaged state of the aforesaid rotor 20, thereby the rotor 20 is rotated (refer to FIGS. 5A–5C and 6A–6D).

In addition, the abutting section of the peripheral protrusion 21*a* of the inner protrusion 62*a* is formed with a slant surface 62*a*-1 (refer to FIGS. 2 and 3). This slant surface 62*a*-1 is formed such that when the writing extremity end 51*a* is pushed toward the rear part of the shaft with a force more than the predetermined load, the inner protrusion 62*a* of the clip 60 is pushed up by the peripheral protrusion 21*a* of the rotor 20 with this load. That is, the clip 60 is constituted such that it is opened by a method wherein the inner protrusion 62*a* is pushed up by the slant surface 62*a*-1 while being slidably contacted with the peripheral protrusion 21*a*.

In addition, it is preferable that the aforesaid load to cause the writing extremity end 51*a* to be pushed rearwardly of the shaft is 2.94N–29.4N (300 gf–3 kgf) and more preferably the value is set to 19.6 N (2 kgf) as applied in the preferred embodiment. A slant angle of the slant surface 62*a*-1 is set in such a way that the peripheral protrusion 21*a* of the rotor 20 pushes up the inner protrusion 62*a* of the clip 60 with this predetermined load to open the clip 60, and more particularly, an angle α (refer to FIG. 2) formed between the side surface of the inner protrusion 62*a* at the cross section and the slant surface 62*a*-1 is set to be about 30°.

Then, an operation of the knock-type writing instrument having the aforesaid configuration will be described.

At first, referring to FIGS. 5A–5C and 6A–6D, the thrust lock mechanism for extending out or retracting the writing extremity end 51*a* into the barrel through the barrel extremity end port 12 under a knock operation of the knock rod 30.

Figure 5A:
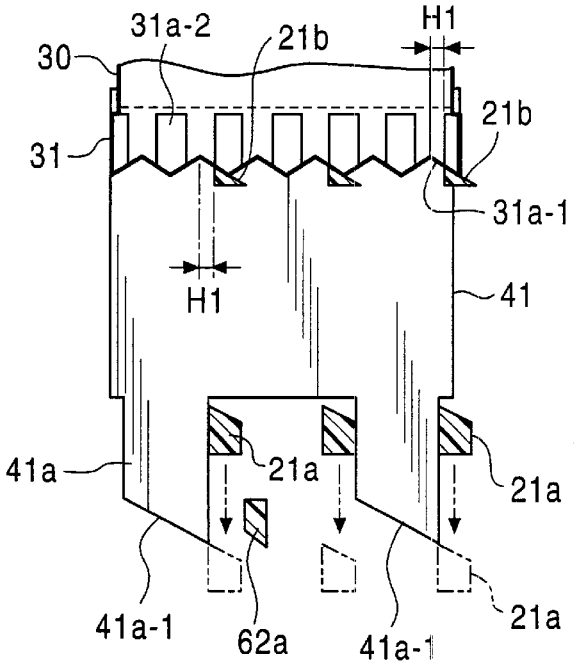
FIGS. 5A to 5C are developed view for showing an operation of a thrust lock mechanism in the knock-type writing instrument when the writing extremity end is projected, wherein 5A shows a state before the writing extremity end is projected, 5B shows a state in which the rotor is slid toward the leading end of the shaft to cause the writing extremity end to be projected and 5C shows a state in which the peripheral protrusions of the rotor are engaged with the inner protrusions of the clip and the projected state of the writing extremity end is kept.
Figure 5B:
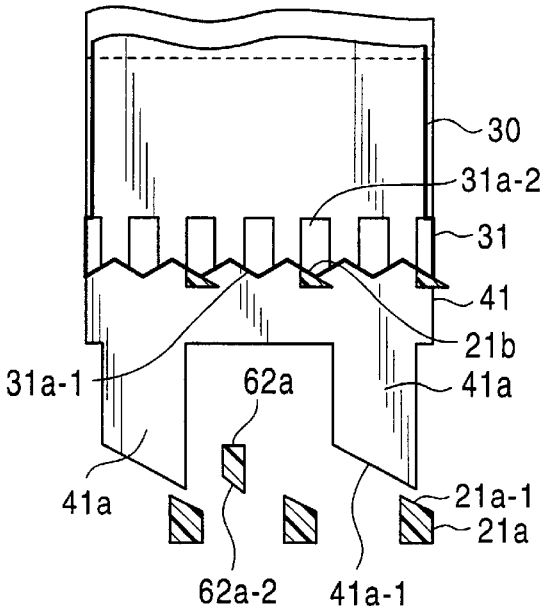
Figure 5C:
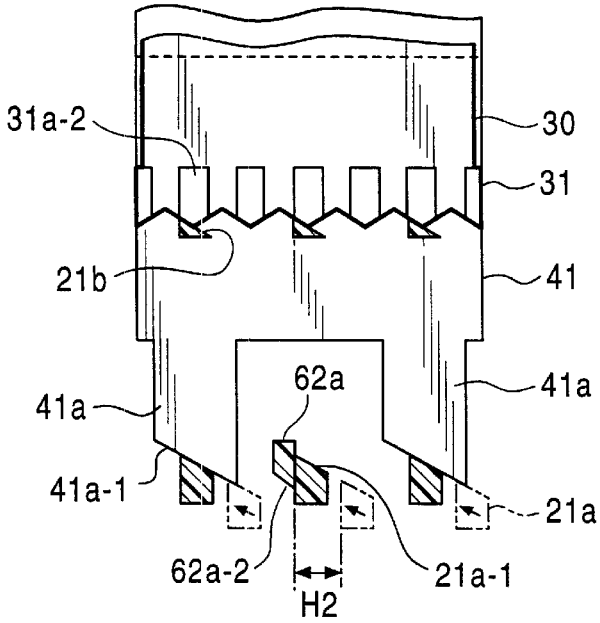

As shown in FIG. 5A, as the knock rod 30 is depressed, the peripheral protrusion 21*a* of the rotor 20 is slid toward the leading side of the shaft along the side surface of the protrusion 41*a* of the fixed cam section 21 and as the peripheral protrusion 21*a* rides over the top part of the protrusion 41*a,* the rotary cam slant surface 21*b* is guided by the thrust cam slant surface 31*a*-1, resulting in that the rotor 20 is rotated by a size H1 shown in this figure and attains the state shown in FIG. 5B. Then, as the pushing operation of the knock rod 30 is started, the peripheral protrusion 21*a* is abutted against the fixed cam slant surface 41*a*-1 of the protrusion 41*a* due to the fact that the rotor 20 is biased by the return spring 70 toward the rear part of the shaft. Then, the peripheral protrusion 21*a* is guided by the fixed cam slant surface 41*a*-1 to cause the rotor 20 to be rotated. Then, as shown in FIG. 5C, the rotor 20 causes one of the peripheral protrusions 21*a* (the central peripheral protrusion 21*a* in this figure) to be abutted against the inner protrusion 62*a* of the clip 60 and then its rotation is stopped at the time when the rotor 20 is rotated by a size H2. At this time, the state in which the writing extremity end 51*a* is extended out of the barrel extremity end port 12 is maintained (the state shown in FIG. 1A).

Figure 6A:
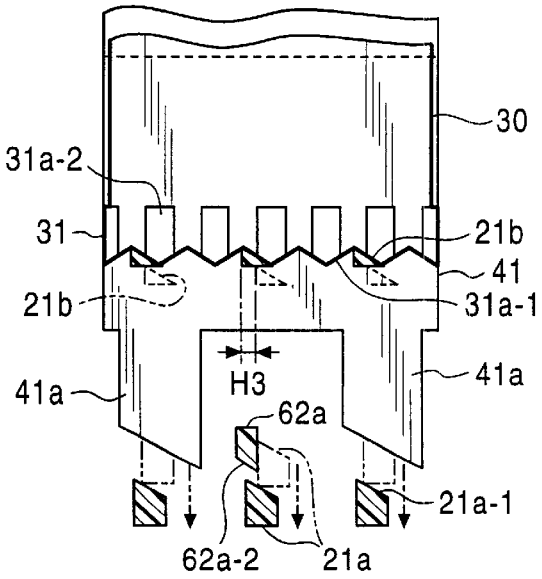
FIGS. 6A to 6C are developed view for showing an operation of a thrust lock mechanism in the knock-type writing instrument when the writing extremity end is retracted into the barrel, wherein 6A shows a state in which the engaged state between the peripheral protrusions of the rotor and the inner protrusions of the clip is released, 6B shows a state in which the peripheral protrusions of the rotor are contacted with the guiding slant surfaces of the inner protrusions of the clip, 6C shows a state in which the peripheral protrusions of the rotor are guided by the inner protrusion guiding slant surfaces of the clip to cause the rotor to be rotated and 6D shows a state in which the rotor is slid in an axial direction to cause the writing extremity end to be retracted into the barrel.
Figure 6B:
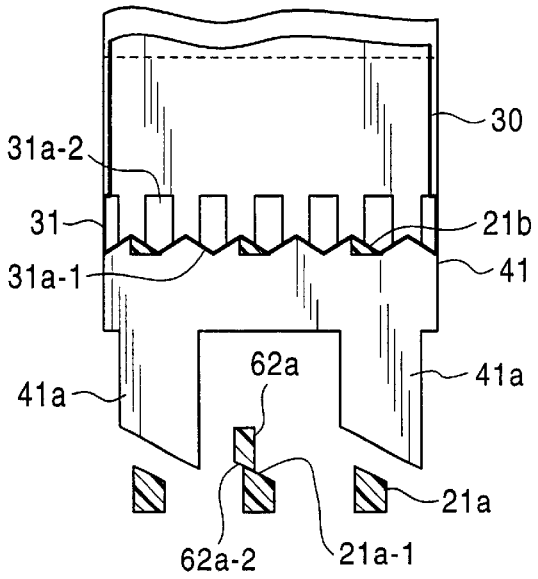
Figure 6C:
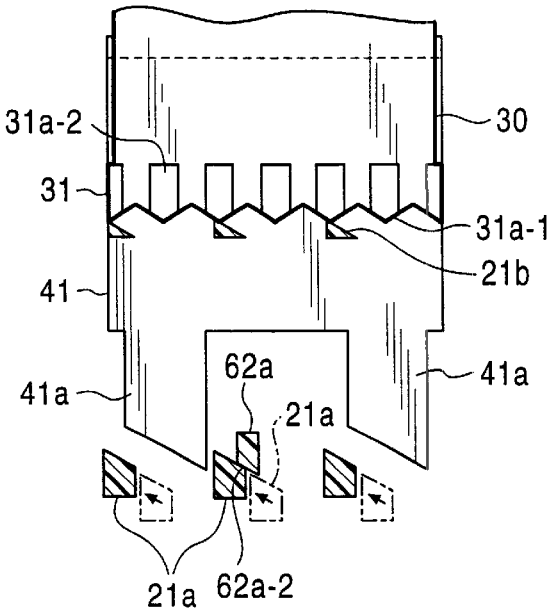
Figure 6D:
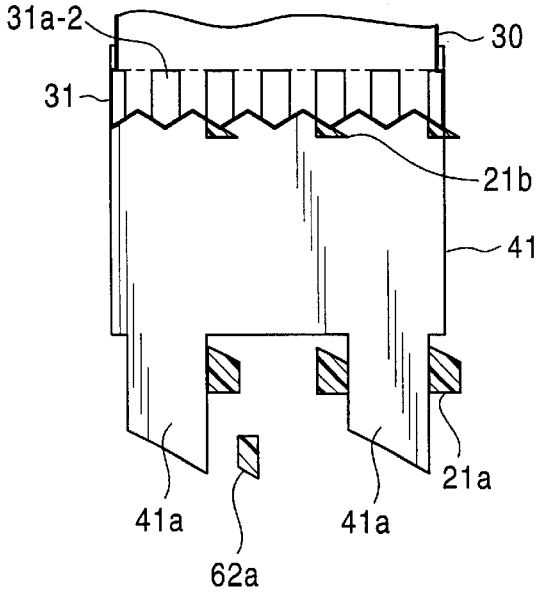

Then, as the knock rod 30 is depressed again under the protruded state of the aforesaid writing extremity end 51*a,* the rotor 20 is slid toward the leading end of the shaft and as shown in FIG. 6A, the peripheral protrusion 21*a* abutted against the inner protrusion 62*a* rides over the top part of the inner protrusion 62*a* and the rotary cam slant surface 21*b* is guided by the thrust cam slant surface 31*a*-1 to cause the rotor 20 to be rotated by a size H3. Then, as the depressing operation of the knock rod 30 is released, since the rotor 20 is biased rearwardly of the shaft with the return spring 70, the peripheral protrusion 21*a* is abutted against the guiding slant surface 62*a*-2 of the inner protrusion 62*a* (refer to FIG. 6B). Then, the peripheral protrusion 21*a* is guided by the guiding slant surface 62*a*-2 to cause the rotor 20 to be rotated (refer to FIG. 6C). Then, as the rotor 20 is further rotated to cause the sliding contacted state between the peripheral protrusion 21*a* and the inner protrusion 62*a* to be released, the rotor 20 and the peripheral protrusion 21*a* are slid toward the rear part of the shaft (refer to FIG. 6D). Accordingly, the writing extremity end 51*a* occupies the retracted position (the state shown in FIG. 1C).

Then, an operation of the clip releasing mechanism will be described as follows.

As the clip 60 is opened under a state in which one of the peripheral protrusions 21*a* of the rotor 20 is abutted against the inner protrusion 62*a* of the clip 60 (the state shown in FIG. 5C), i.e. a state in which the writing extremity end 51*a* keeps its projected position, the inner protrusion 62*a* is moved outwardly of the shaft, resulting in that said peripheral protrusion 21*a* is not abutted against the inner protrusion 62*a*. Accordingly, each of the other two peripheral protrusions 21*a,* 21*a* of the rotor 20 is guided by the fixed cam slant surface 41*a*-1 of the rear end barrel 40 to cause the rotor 20 to be rotated. As each of said two peripheral protrusions 21*a,* 21*a* rides over the end part of the fixed cam slant surface 41*a*-1, the rotor 20 and the peripheral protrusion 21*a* are slid toward the rear end of the shaft, resulting in that they become the state shown in FIG. 6D. Thus, the writing extremity end 51*a* is retracted into the barrel extremity end port 12.

Figure 1B:
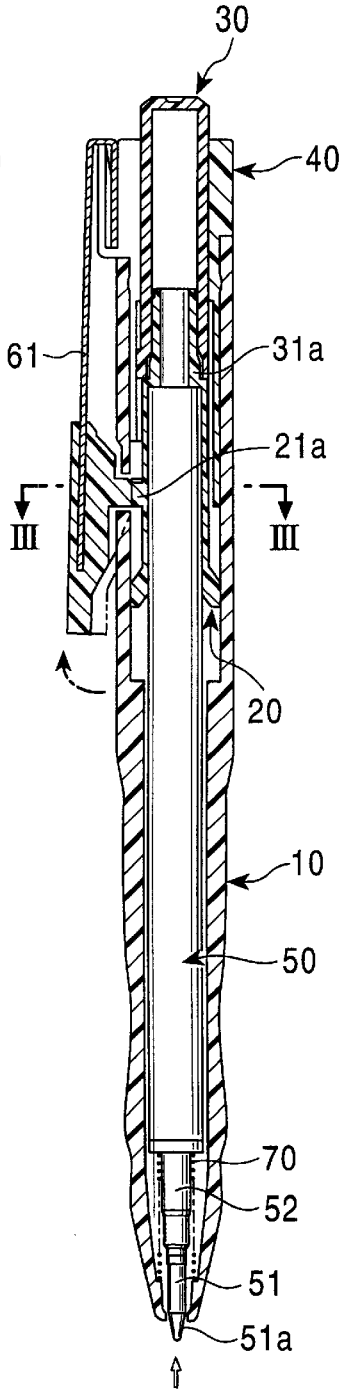
Figure 1C:
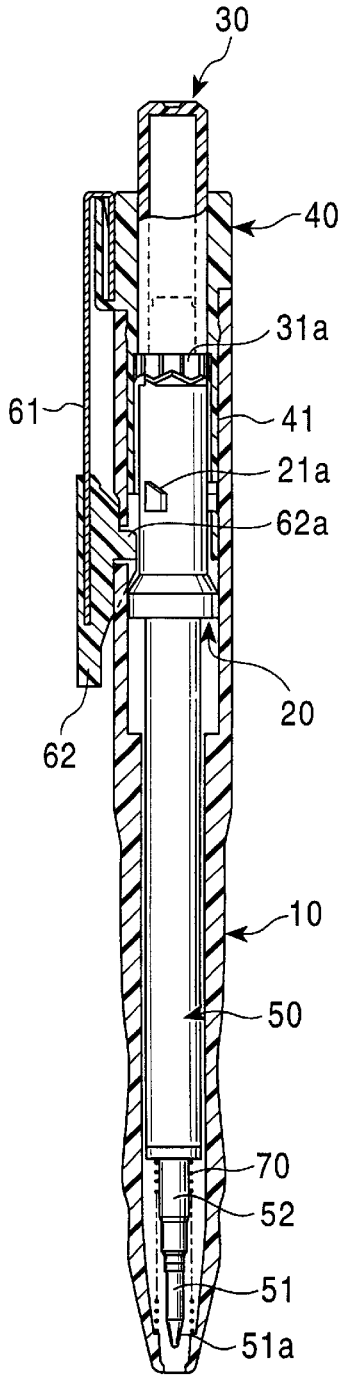

In addition, when the writing extremity end 51*a* is pushed toward a rear part of the shaft with a force more than the predetermined load under a state in which one of the peripheral protrusions 21*a* of the rotor 20 is abutted against the inner protrusion 62*a* (the state shown in FIG. 5C), i.e. the state in which the writing extremity end 51*a* keeps its projected position in the same manner as that described above, said inner protrusion 62*a* is pushed up while the slant surface 62*a*-1 of the inner protrusion 62*a* of the clip 60 is being slidably contacted with the peripheral protrusion 21*a* of the rotor 20 to be rotated under this load (refer to FIGS. 1B and 3). That is, the clip 60 is opened, the operation of the aforesaid clip releasing mechanism is performed in the same manner as that above to attain the state shown in FIG. 6A and the writing extremity end 51*a* is retracted into the barrel extremity end port 12.

In addition, in the aforesaid preferred embodiment, it has been described about the embodiment in which the clip 60 is opened when the writing extremity end 51*a* at the projected position is depressed with a force more than a predetermined load, i.e. the embodiment concerning claims 2 to 4. However, it is not necessarily required in claim 1 that there is provided the aforesaid preferred embodiment. In other words, in the case of claim 1, it is satisfactory that the opening operation is not carried out when the writing extremity end 51*a* at its projected position is depressed under no formation of the aforesaid slant surface 62*a*-1 or increasing of tension force of the clip 60.

In accordance with the present invention, since its constitution is made such that the plurality of peripheral protrusions are arranged at the outer peripheral surface of the rotor in a circumferential direction and one of these peripheral protrusions is abutted against the inner protrusion of the clip to cause the rotor to be stopped, it is not necessary to provide a constitution that the protrusions to be guided along the fixed cam slant surface of the inner surface of the barrel and the protruded engaging section to be engaged with the concave engaged section inside the ball section at the clip extremity end are separately installed in an axial direction at the outer circumferential surface of the rotor as found in the aforesaid prior art structure, resulting in that it is possible to prevent the writing instrument from staining the cloth when it is stored in the pocket of it by the clip releasing mechanism having a short axial length of the rotor and compact structure, and further elongated length of the refill facilitates an increased amount of ink in the writing instrument, and arranging of a short barrel as well as a compact-sized writing instrument and the like.

In addition, the constitution of the clip in which the inner protrusions of the clip are pushed up by the peripheral protrusions of the rotor to be abutted when the writing extremity end at the projected position is pushed toward the rear part of the shaft with a force more than a predetermined load causes the engaged state of the rotor to be released, the writing extremity end to be retracted and the writing extremity end to be protected in the case that a load applied to the rear part of the shaft more than the required load is applied to the writing extremity end such as in the case that the writing instrument is dropped with the projected writing extremity end being faced downward or in the case that the writing is carried out with an excessive writing pressure.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. A knock-type writing instrument having a clip releasing mechanism and comprising:

a barrel having a front end and a rear end;

a window hole at a peripheral surface of said barrel;

a knock rod coaxially slidably affixed to said rear end of said barrel, said knock rod having a first end protruding from said barrel, and having a second end extending into said barrel, said knock rod configured to extend, to an extended position, a writing end of a refill from said front end of said barrel, said knock rod further configured to retract, to a retracted position, the writing end of said refill into said front end of said barrel;

a thrust lock mechanism comprising:

a spring;

a rotor comprising a plurality of peripheral protrusions radially extending about the circumference thereof;

a fixed cam slant surface affixed to an inside surface of said barrel;

a thrust cam slant surface affixed to said second end of said knock rod;

a rotary cam slant surface affixed to a rear end of the rotor; and a guiding slant surface;

a clip having a first end and a second end, said first end affixed to said barrel, and a ball affixed to said second end, said ball having an inner protrusion removably said window hole of said barrel, said guiding slant surface affixed to said clip at said inner protrusion of said ball, wherein said ball operably engages said rotor when the refill is in said extended position, and wherein said ball is disengaged from said rotor when the refill is in said retracted position;

wherein:

at least one peripheral protrusion of said plurality of peripheral protrusions is configured to stop rotation of said rotor by abutting against said inner protrusion of said ball, when the refill is in said extended position;

when a knock operation is performed to extend the refill to said extended position:

said rotary cam slant surface is guided by the thrust cam slant surface;

said thrust lock mechanism is configured to rotate said rotor while said at least one peripheral protrusion is guided by the fixed cam slant surface; and said at least one said peripheral protrusion is abutted against said inner protrusion to stop said rotor; and when a knock operation is performed to retract the refill to said retracted position:

said rotary cam slant surface is guided by the thrust cam slant surface; and one of said peripheral protrusions abutted against the inner protrusion is guided by said guiding slant surface of the inner protrusion to rotate the rotor and retract the refill.

2. A knock-type writing instrument having a clip releasing mechanism and comprising:

a barrel having a front end and a rear end;

a window hole at a peripheral surface of said barrel;

a knock rod coaxially slidably affixed to said rear end of said barrel, said knock rod having a first end protruding from said barrel, and having a second end extending into said barrel, said knock rod configured to extend, to an extended position, a writing end of a refill from said front end of said barrel, said knock rod further configured to retract, to a retracted position, the writing end of the refill into said front end of said barrel;

a thrust lock mechanism comprising:

a spring; and a rotor comprising a plurality of peripheral protrusions radially extending about the circumference thereof;

a clip having a first end and a second end, said first end affixed to said barrel, and a ball affixed to said second end, said ball having an inner protrusion removably insertable into said window hole of said barrel, wherein said ball operably engages said rotor when the refill is in said extended position, and wherein said ball is disengaged from said rotor when the refill is in said retracted position;

wherein at least one peripheral protrusion of said peripheral protrusions is configured to stop rotation of said rotor by abutting against said inner protrusion of said ball, when the refill is in said extended position; and wherein said abutted peripheral protrusion is configured to push said inner protrusion substantially radially outward when a force greater than a predetermined load is applied to the writing end of the refill, at said extended position and transmitted through the refill to said abutted peripheral protrusion.

3. The knock-type writing instrument according to claim 2, wherein said inner protrusion has an oblique surface at the point where said peripheral protrusion abuts against said at least one inner protrusion, said oblique surface configured to slidably contact said at least one peripheral protrusion and further configured to be pushed substantially radially outward.

4. The knock-type writing instrument according to claim 3 wherein an angle of said oblique surface is approximately 30 degrees.

* * * * *